US005933063A

United States Patent [19]

Keung et al.

[11] Patent Number: 5,933,063

[45] Date of Patent: Aug. 3, 1999

[54] GROUND FAULT CIRCUIT INTERRUPTER

[75] Inventors: Wan Yiu Keung, Tai Po; Cheng Wai Chun, Kowloon, both of The Hong Kong Special Administrative Region of the People's Republic of China

[73] Assignee: Rototech Electrical Components, Inc., Hicksville, N.Y.

[21] Appl. No.: 08/897,558

[22] Filed: Jul. 21, 1997

[51] Int. Cl.[6] ..... H01H 73/00

[52] U.S. Cl. ..... 335/18; 335/242; 335/265; 335/177

[58] Field of Search ..... 335/18, 202, 232, 335/242, 251, 259, 265, 166–76, 177–79

[56] References Cited

U.S. PATENT DOCUMENTS 3,566,189 2/1971 Wilson .
3,708,723 1/1973 Shand et al. .
3,855,502 12/1974 Pardue et al. .
3,914,720 10/1975 Drubig ..... 335/236
3,976,011 8/1976 Crescas et al. .
3,987,383 10/1976 Antonitsch .
4,001,647 1/1977 Klein et al. .
4,013,929 3/1977 Dietz et al. .
4,034,266 7/1977 Virani et al. .
4,077,505 3/1978 Giolitti et al. .
4,086,549 4/1978 Slater et al. .
4,135,134 1/1979 Ebel et al. .
4,179,701 12/1979 Bärtschi .
4,272,034 6/1981 Dimitrov .
4,337,447 6/1982 Lemmer .
4,345,225 8/1982 Lemmer .
4,481,493 11/1984 Kobler et al. .
4,490,590 12/1984 Matsuda .
4,521,824 6/1985 Morris et al. .
4,550,266 10/1985 Kille et al. .
4,574,260 3/1986 Franks .
4,578,660 3/1986 Hanada et al. .
4,584,497 4/1986 Butman, Jr. et al. .
4,587,501 5/1986 Agatahama et al. .
4,595,894 6/1986 Doyle et al. .
4,620,717 11/1986 Bagalini .
4,630,015 12/1986 Gernhardt et al. .
4,646,043 2/1987 Hoffman ..... 335/251
4,802,052 1/1989 Brant et al. .
5,202,662 4/1993 Bienwald et al. .
5,223,810 6/1993 VanHaaren .
5,260,676 11/1993 Patel et al. .
5,264,811 11/1993 Takeda .
5,457,444 10/1995 Cook .
5,477,201 12/1995 Garnto et al. .
5,510,760 4/1996 Marcou et al. .
5,517,165 5/1996 Cook .
5,563,756 10/1996 Ignasiak .
5,594,398 1/1997 Marcou et al. .

*Primary Examiner*—Lincoln Donovan
*Attorney, Agent, or Firm*—Thomas L. Adams

[57] ABSTRACT

A ground fault circuit interrupter has a pair of stationary contacts and a pair of movable contacts mounted in a housing. Also included is an electromagnetic coil mounted in the housing for generating an electromagnetic field. The interrupter also has a plunger and an armature, each slidably mounted at least partially within the electromagnetic coil. The armature can be magnetically driven by the coil against the plunger. A latch means is included for releasably holding the pair of movable contacts against the pair of stationary contacts. A fault detector can detect a fault in an electrical distribution system in order to actuate the electromagnetic coil.

17 Claims, 7 Drawing Sheets

86
42
46
84
82
44
46
12
80
78
83
76
66A
72,74
66B
66C
66
68,70
64A
64B
64
64C
62
50
60
52
59
56
58
54
36
48
40
40
36
32
72
38
34

GROUND FAULT CIRCUIT INTERRUPTER

BACKGROUND OF THE INVENTION

1. Field of the Invention

The present invention relates to ground fault circuit interrupters (GFCI), and in particular, to interrupters having a latch means for holding a pair of movable contacts against a pair of stationary contacts.

2. Description of Related Art

A ground fault occurs when current improperly flows through a ground line. Such a current flow indicates that an improper current path has been made from the primary power lines. Such a condition may indicate a shock hazard, even when the current flow is insufficient to trip the main breaker. Known ground fault circuit interrupters have been mounted in a receptacle housing with a detector to sense the ground fault condition. A ground fault is often detected by determining whether there is an imbalance in current between the two primary power lines. One or more toroidal coils can encircle the primary power lines to detect an imbalance in the currents in those lines. The imbalance can produce an output voltage from the toroidal coil to trigger a semiconductor circuit that energizes a solenoid coil. The solenoid coil can drive an armature to release a latch that otherwise holds a pair of moveable contacts against a pair of stationary contacts. When the moveable contacts are released, power is disconnected from the sockets on the receptacle protected by the ground fault circuit interrupter.

A known GFCI has in its bottom compartment an L-shaped, spring-loaded latch that is slidably mounted in grooves in the base of a rectangular block having an axial bore. Two arms extend from the rectangular block for deflecting a pair of cantilevered, moveable contacts. A spring-biased reset button is molded onto a metal pin having an annular groove adjacent a tapered tip. This pin is designed to extend through the axial bore in the rectangular block and engage a central hole in the L-shaped, sliding latch. The tapered tip pushes through this hole to retract the sliding latch. When the annular groove on the pin reaches the hole in the spring-loaded latch, it latches onto the groove on the pin. Thereafter springs on the reset button lift the pin and the rectangular block to drive the cantilevered contacts against stationary contacts, in order to power the outlet sockets of the GFCI.

A solenoid is mounted adjacent to this sliding, L-shaped latch. When actuated, the solenoid armature is pulled into the solenoid coil to compress a solenoid spring and slide the spring-loaded latch to an unlatched position, thereby releasing the pin of the reset button. This allows the rectangular block and the latch to disengage the cantilevered contacts, which now return to their neutral position, spaced from the fixed contacts.

Another GFCI of this type is shown in U.S. Pat. Nos. 5,510,760 and 5,594,398. In these references, the latch is in the form of a single metal stamping, shaped to include an integral spring. This latch is not mounted to slide in grooves on a latch block, but is simply mounted below a latch block used to lift moveable contacts. The latch is operated when the armature of a solenoid extends to push the latch and release a latch pin, which then lifts the latch block to close the contacts. A disadvantage with this device is the tendency of the latch to become magnetized and stick to the armature. Also, the armature must receive a relatively high electromotive force before overcoming friction with the latch pin.

The GFCI in U.S. Pat. No 4,630,015 has a solenoid armature that pushes cam actuators to separate contacts and thereby remove power from outlet sockets. See also U.S. Pat. No. 5,223,810.

The GFCI shown in U.S. Pat. No. 4,802,052 has an L-shaped latch plate that is pulled, not pushed, by a solenoid armature. For this reason, the latch has a pair of legs that straddle the solenoid armature between a spaced pair of collars. The GFCI in U.S. Pat. No. 4,595,894 also has a latch plate with a pair of legs that straddle a groove on a solenoid armature. When this solenoid retracts, it pulls the latch plate to release a pair of moveable contacts.

Also, the solenoid coil in U.S. Pat. No. 4,595,894 is mounted above a separator inside a receptacle housing. The solenoid coil is near the longitudinal center of the housing. The latch plate that connects to the tip of the solenoid armature is directed to extend back under the solenoid coil. This requires a great deal of the latching mechanism to be placed in a crowded area that contains the solenoid coil and other mechanisms.

A typical disadvantage with the foregoing GFCI units is that the solenoid coil is crowded, often against the latch mechanism or the ground fault detecting circuitry. To accommodate the solenoid and to allow room for the latching mechanism, these solenoid coils are generally mounted to one end of the compartment. While the solenoid coil in U.S. Pat. No. 4,595,894 is centrally mounted in a different compartment than the ground fault detecting circuit, its latching mechanism tends to be crowded around the solenoid coil.

Other GFCI units are shown in U.S. Pat. Nos. 5,260,676; 5,457,444; 5,477,201; and 5,517,165. See also U.S. Pat. Nos. 5,264,811; and 5,563,756.

A significant disadvantage with the foregoing latch mechanisms is the relatively high resistance to initially moving the latch. A latch plate must typically overcome friction to slide past a shoulder or other engagement surface before being released. Once the latch plate moves the rather small distance needed for release, the latch plate can then slide with very little resistance, other than spring biasing.

Accordingly, the bulk of the useful energy consumed by the solenoid coil is only for the initial period when the frictional resistance must be overcome. Consequently, the solenoid coil will need a relatively high current while the armature is stalled to produce enough magneto motive force to eventually move the armature. Therefore, solenoid coils are usually over designed, simply to provide sufficient initial force required to overcome the friction.

Accordingly, there is a need for an improved GFCI that uses space efficiently and has a solenoid that is adapted to efficiently overcome the frictional forces associated with releasing a latch mechanism.

SUMMARY OF THE INVENTION

In accordance with the illustrative embodiments demonstrating features and advantages of the present invention, there is provided a ground fault circuit interrupter for an electrical distribution system. The interrupter has a housing together with a pair of stationary contacts and a pair of movable contacts mounted in the housing. Also included is an electromagnetic means mounted in the housing for generating an electromagnetic field. The interrupter also includes a plunger slidably mounted at least partially within the electromagnetic means. Also included is an armature slidably mounted at least partially within the electromagnetic means to be magnetically driven thereby against the plunger. The interrupter further includes a latch means for releasably holding the pair of movable contacts against the pair of stationary contacts. Also included is a detection means for detecting a fault in the electrical distribution system in order to actuate the electromagnetic means.

By employing apparatus of the foregoing type, an improved GFCI is achieved. In a preferred embodiment, a solenoid coil contains a magnetically attractable armature as well as a non-magnetic plunger. The plunger and the armature are preferably separated by a compression spring placed between them. This enables the preferred armature to begin moving while the frictionally bound plunger stays stationary. Therefore, the armature can build up speed before striking the plunger. Thus, the armature can build up kinetic energy over an extended time interval, and quickly transfer that kinetic energy to the plunger. Upon impact, the plunger can overcome friction to extend outwardly and push the preferred, L-shaped latch plate. This motion releases the latch plate from a groove on a resetting shaft. As a result, the latch plate and an associated latch arm are freed to allow cantilevered moving contacts to separate from stationary contacts. This separation removes power from receptacles inside the GFCI housing.

Also in this preferred embodiment, the solenoid is centrally mounted on a separator on the opposite side from the fault detecting circuit. This positioning provides additional clearance around the solenoid. Preferably, the latch mechanism is mounted at one end of the solenoid to avoid crowding the latching mechanism around the circumference of the solenoid.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
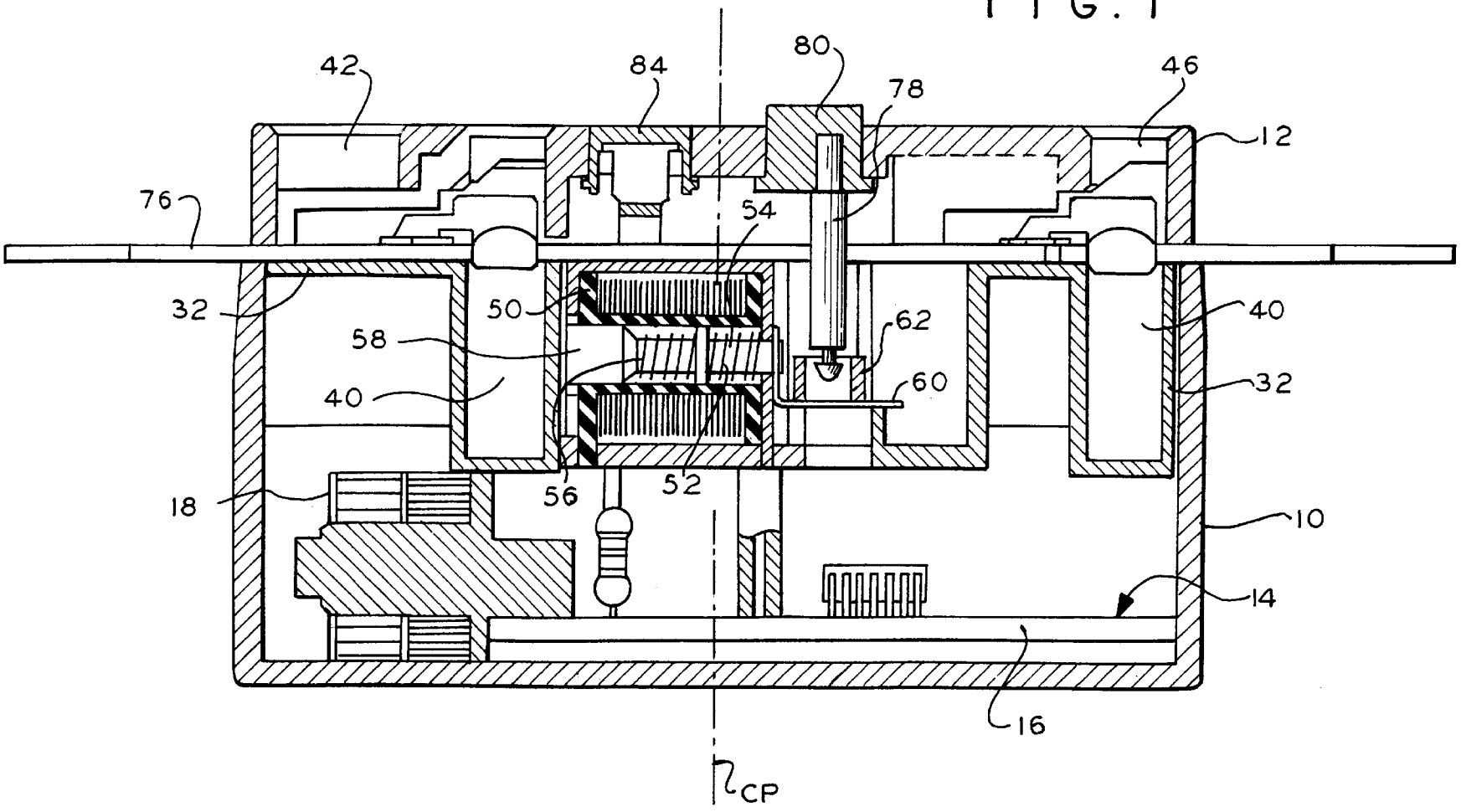
FIG. 1 is a side view, in longitudinal section, of a ground fault circuit interrupter (GFCI), in accordance with principles of the present invention.
Figure 2:
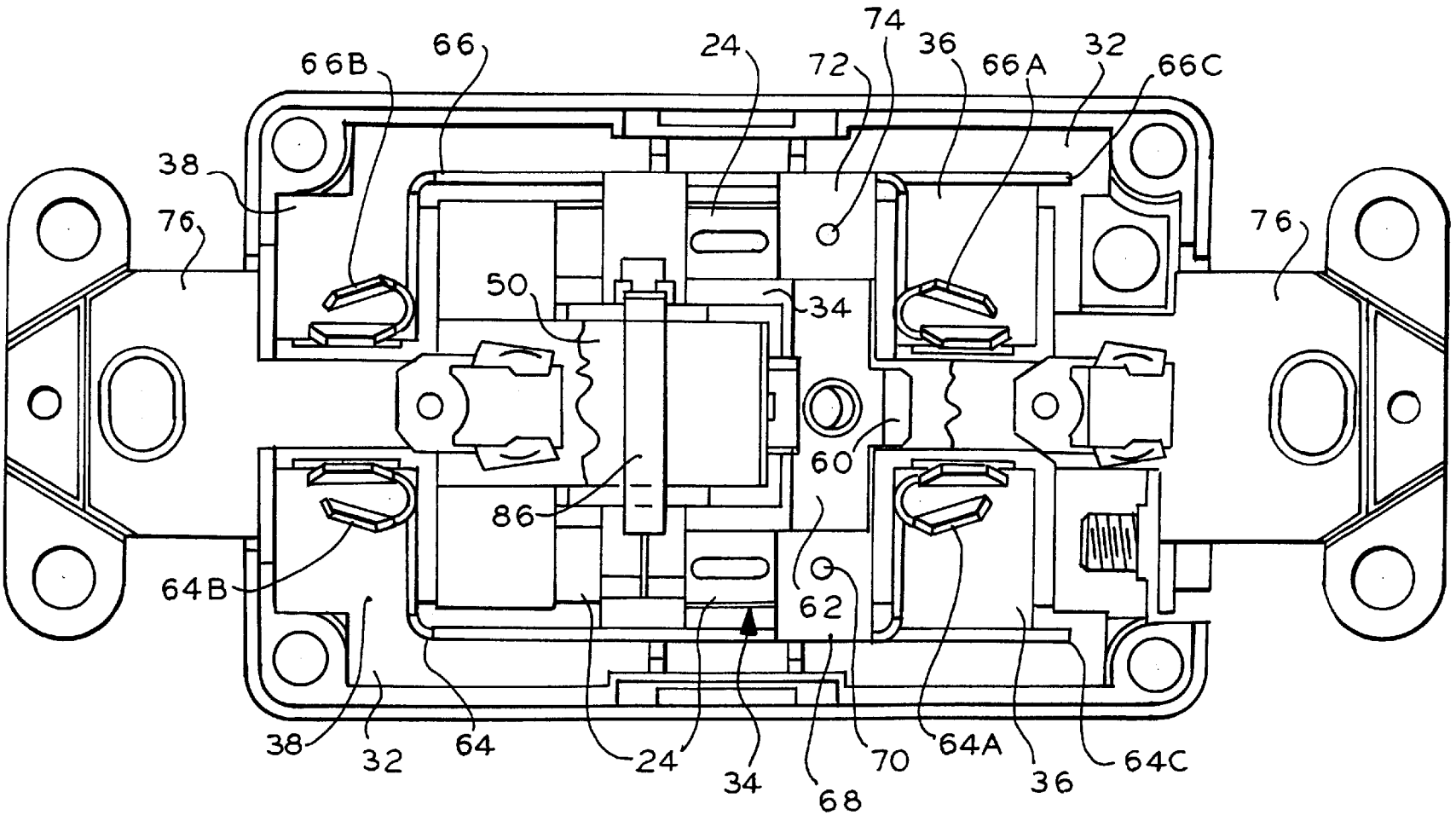
FIG. 2 is a top view of the GFCI of FIG. 1 with its cover removed.

Referring to FIGS. 1, 2, 3A and 3B a housing for a GFCI is shown as a case 10 with a cover 12. A detection means 14 is mounted in the bottom of the casing 10. Detection means 14 includes a printed circuit board 16 (no components shown thereon for illustrative purposes), and a toroidal current sensor 18. Toroidal detector 18 senses current in bus wires 20, which connect between the forked terminals 22 and the cantilevered arms 24. Forked terminals 22 can straddle the screw terminals 26, which protrude through the openings 28 in housing 10. The free ends of arms 24 support a pair of moveable contacts 30.

A separator 28 is placed over the detection means 14 and the cantilevered arms 24, but the tips of the cantilevered arms 24 are not covered due to the openings 34 in separator 32. Separator 32 has a pair of pockets 38 on one end and a pair of pockets 36 on the opposite end, which align with the slots 42 and 44, respectively, of cover 12. Separator 32 also has a pair of holes 40 that align with the openings 46 in cover 12. A support bracket 76 is shown mounted between the separator 32 and cover 12.

Separator 32 also has a rectangular socket 48, sized to hold coil 50, which is part of an electromagnetic means. As described further hereinafter, coil 50 contains a retraction means, shown herein as a compression spring 52 that bears against a plunger 54. A staineless steel armature 58 is mounted behind this plunger 54 and separated therefrom by a compression spring 56, also referred to as a separating means. The distal tip of plunger 54 connects to a latch member 60 which together with yoke 62 and reset shaft 78 acts as part of a latch means. Coil 50 is shown at a position intersecting a longitudinally centered, transverse plane CP. The latch means comprising latch member 60, yoke 62, and reset shaft 78 are spaced from the plane CP. Thus the coil 50 is closer to the longitudinally centered plane CP than the latch means.

A pair of stamped contacts 64 and 66 are shaped to fit atop the separator 52. Stamped contacts 64 have a pair of arms that terminate in U-shaped receptacles 64A and 64B, which are designed to fit in previously mentioned pockets 36 and 38, respectively. Stamping 64 also has a ledge 68 that supports a stationary contact 70. Stamping 64 also has a dependent forked contact 64C that is shaped to: (a) slip into the slot 72 in separator 32., (b) align with the openings 29 in housing 10, and (c) fit around the screw terminals 27. In a similar fashion, stamped contact 66 has on its arms a pair of U-shaped receptacles 66A and 66B, also designed to fit into mating pockets 36 and 38, respectively, on the opposite side of separator 32. Stamped contact 66 also has a ledge 72 supporting a stationary contact 74 and a forked contact 66C designed to fit into a mating slot (not shown) in separator 32.

A reset shaft 78 is molded into the underside of a reset button 80, which projects out through hole 82 in cover 12 Shaft 78 and button 80 are outwardly biased by a pair of compression springs 83, herein referred to as a bias means. Also, a test button 84 mounted to reciprocate in cover 12 can deflect metal test strap 86 which is mounted to straddle bracket 76 and pivotally attach to the separator 32.

Referring now to FIGS. 4, 5A, 5B, and 6, electromagnetic means 50 is shown comprising a bobbin 50A in the form of a plastic tube terminating in a pair of parallel, rectangular flanges. One of the flanges has a pair of bosses that support embedded leads 90. Leads 90 are electrically connected to a coil 50B, wound around the bobbin 50A. A solenoid bracket 51 reaches across both ends of the bobbin 50A to facilitate completion of a magnetic circuit.

Armature 58 is also shown as an axially symmetric element, having a cylindrical main body 58A and a cylindrical, proximal stub 58B. Plunger 54 is also shown as an axially symmetric brass element, having a cylindrical proximal flange 54A, and a distal tip 54B in the form of a cylindrical section with an annular groove 54C. Armature 58 and plunger 54 are coaxially mounted inside the bobbin 58 along axis 92.

Figure 7:
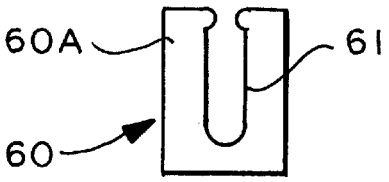
FIG. 7 is an end view of the latch plate of FIG. 1.
Figure 8:
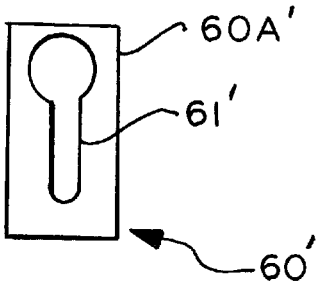
FIG. 8. is an end view of a latch plate that is an alternate to that of FIG. 7.

Latch member 60 is shown as an L-shaped metal stamping having a transverse arm 60A and a longitudinal arm 60B with a hole 59. The outer end of longitudinal arm 60B is referred to as a distal end. FIG. 7 shows that the transverse arm 60A is forked to provide a slot 61 in which the groove 54C of plunger 54 rides. In FIG. 8, the transverse arm 60A' of an alternate latch member 60 is shown with a modified slot 61'. In that embodiment, the slot merges with an enlarged hole to form a shape similar to a keyhole, although the shape can be modified in alternate embodiments. With the arrangement of FIG. 8, the distal tip 54C (FIG. 4) is inserted into the enlarged hole at the end of slot 61'. Thereafter, the groove 54C is slid into the slot 61'. Once in the narrowed portion of slot 61', the plunger tip 54B is locked in place although still retaining the ability to slide along the length of the slot 61'.

In operation, power lines may be connected to screw terminals 26 (FIG. 3B), which are accessible through the openings 28 in housing 10. This connects power to forked terminals 22, which are connected to the inside ends of buses 20. Buses 22 are routed through the center of the toroidal detection coils 18 to power the cantilevered arms 24. Thus, power is normally applied to moveable contacts 30.

Figure 5A:
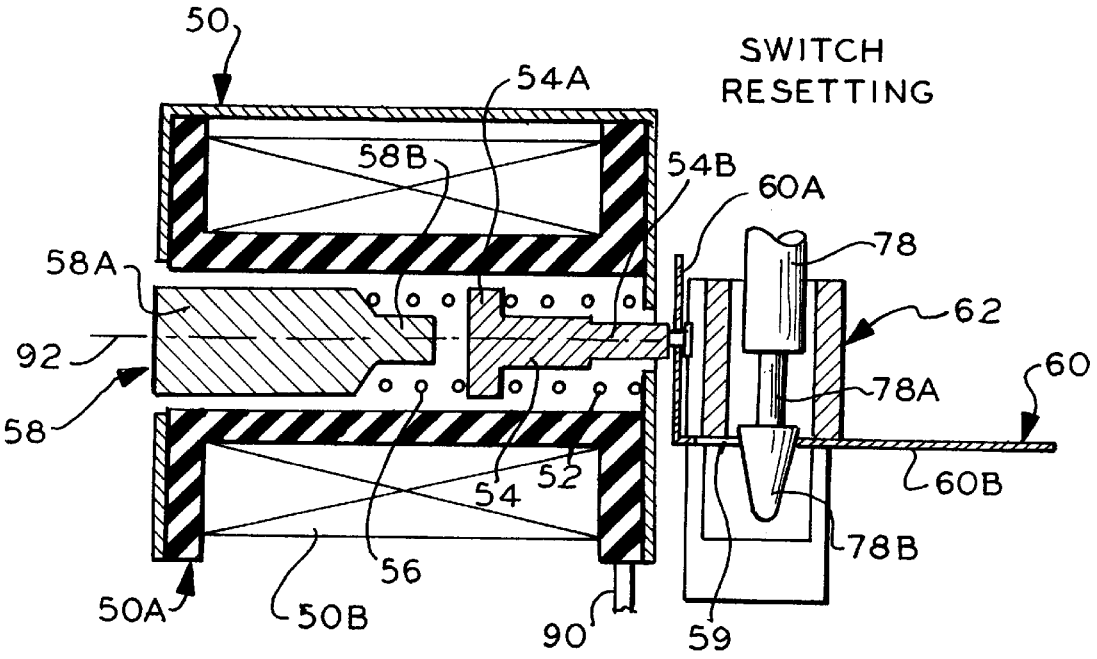
FIG. 5A is a detailed, sectional, side view of the electromagnetic means and a portion of the latch means of FIG. 1, showing the reset shaft about to latch onto the latch plate.

In FIG. 5A, the yoke 62 is shown in a retracted, released position. Consequently, cantilevered arms 24 (FIGS. 3B and 6) are free to retract to their neutral position to separate moving contacts 30 from stationary contacts 70 and 74.

The device can be reset by depressing button 80 (FIG. 3), which causes tip 78B (FIG. 5A) of shaft 78 to penetrate the hole 59 in arm 60B of latch member 60. As shown in FIG. 5A, the tapered sides of tip 78B drive latch 60 away from the coil 50.

Figure 5B:
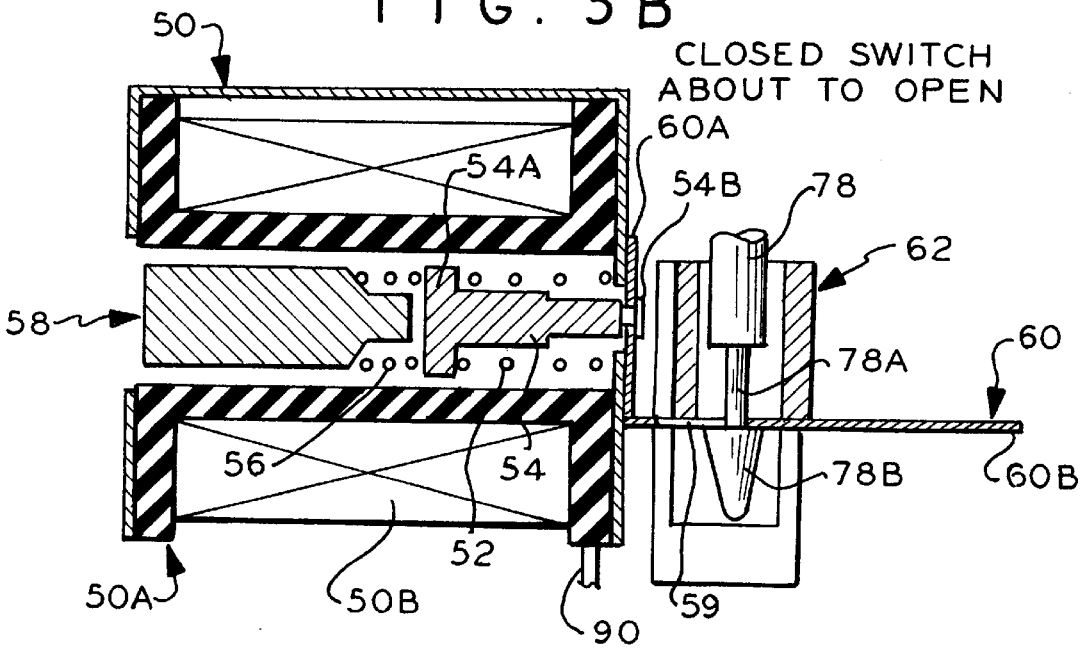
FIG. 5B is a detailed, sectional, side view of the mechanism of FIG. 5A, showing the reset shaft latched on the latch plate, and the armature about to strike the plunger.
Figure 6:
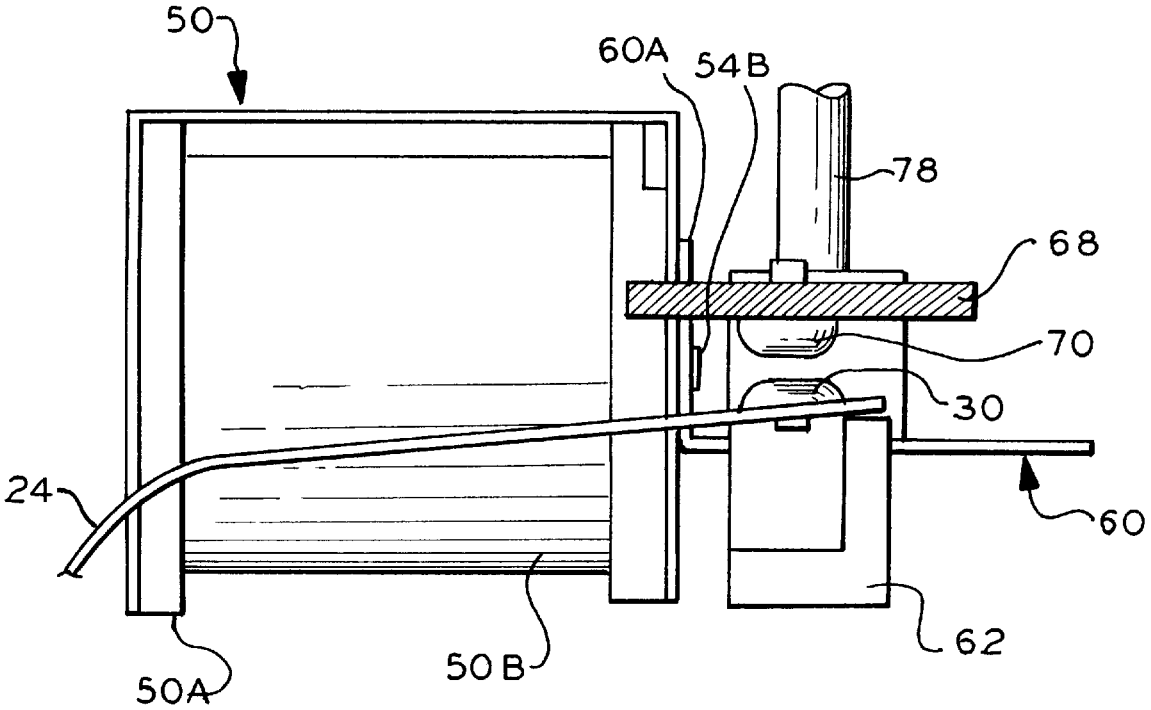
FIG. 6 is a detailed side view of the mechanism of FIGS. 5A and 5B, showing the moveable contact in transit.

Eventually, the tip 78B clears the hole 59 in arm 60B and the latch arm 60B will then fall into the groove 78A as shown in FIG. 5B. The shaft 78 is then latched onto the latch member 60. When the user no longer depresses button 80, the springs 83 (FIG. 3A) lift button and shaft 78. As shown in FIG. 5B, lifts member 60 and causes arm 60A of latch member 60 to slide through the groove in the tip 54B of plunger 54. As a result, the yoke 62 is lifted by shaft 78, to also lift the cantilevered arms 24 FIGS. 3 and 6). In FIG. 6, arm 24 is shown in transit with contact 30 approaching contact 70. Eventually, contacts 30 and 70 will make contact when yoke 62 rises to the position shown in FIG. 5B.

Figure 3A:
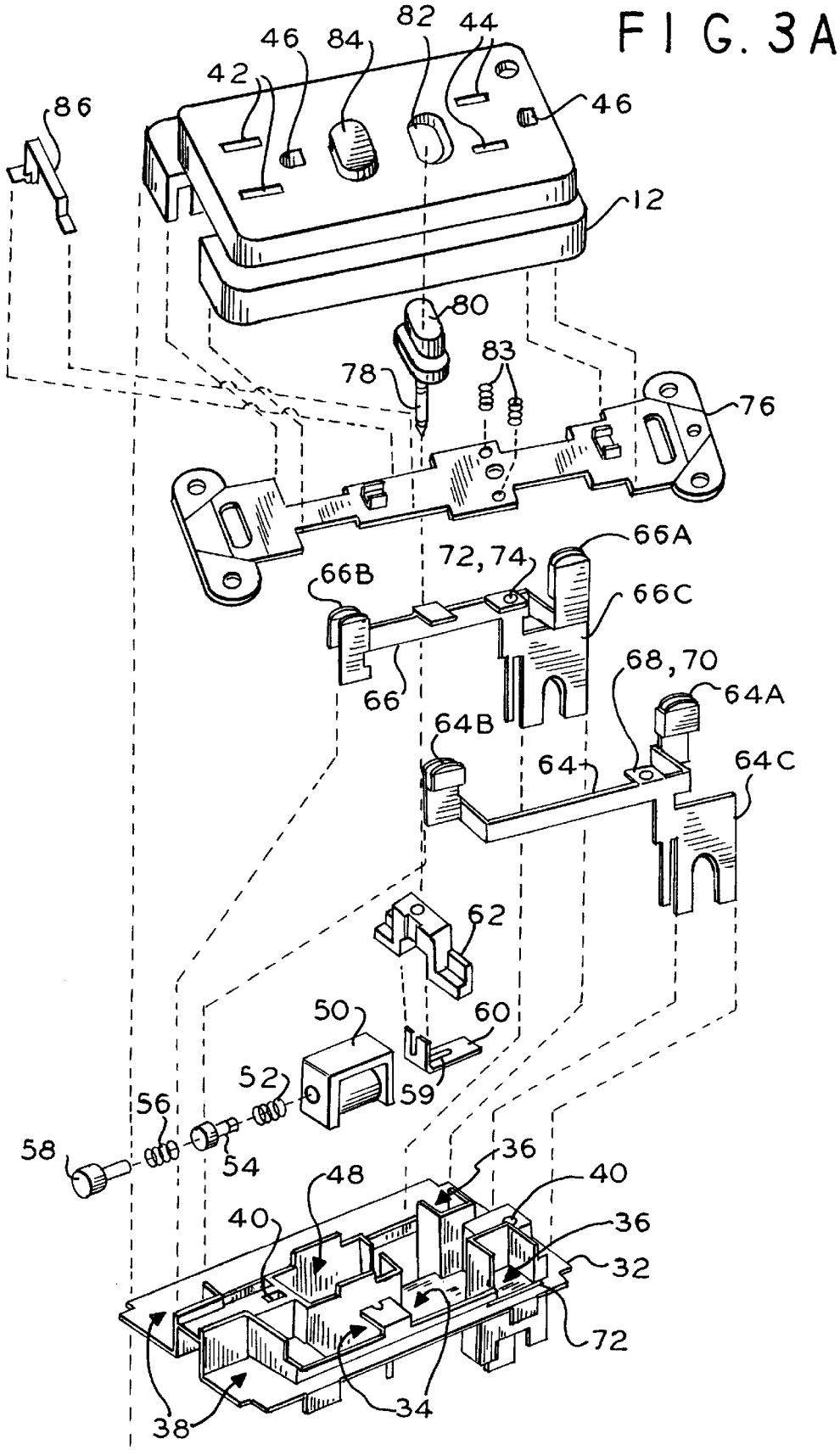
FIGS. 3A and 3B is an exploded view of the GFCI of FIG. 1.
Figure 3B:
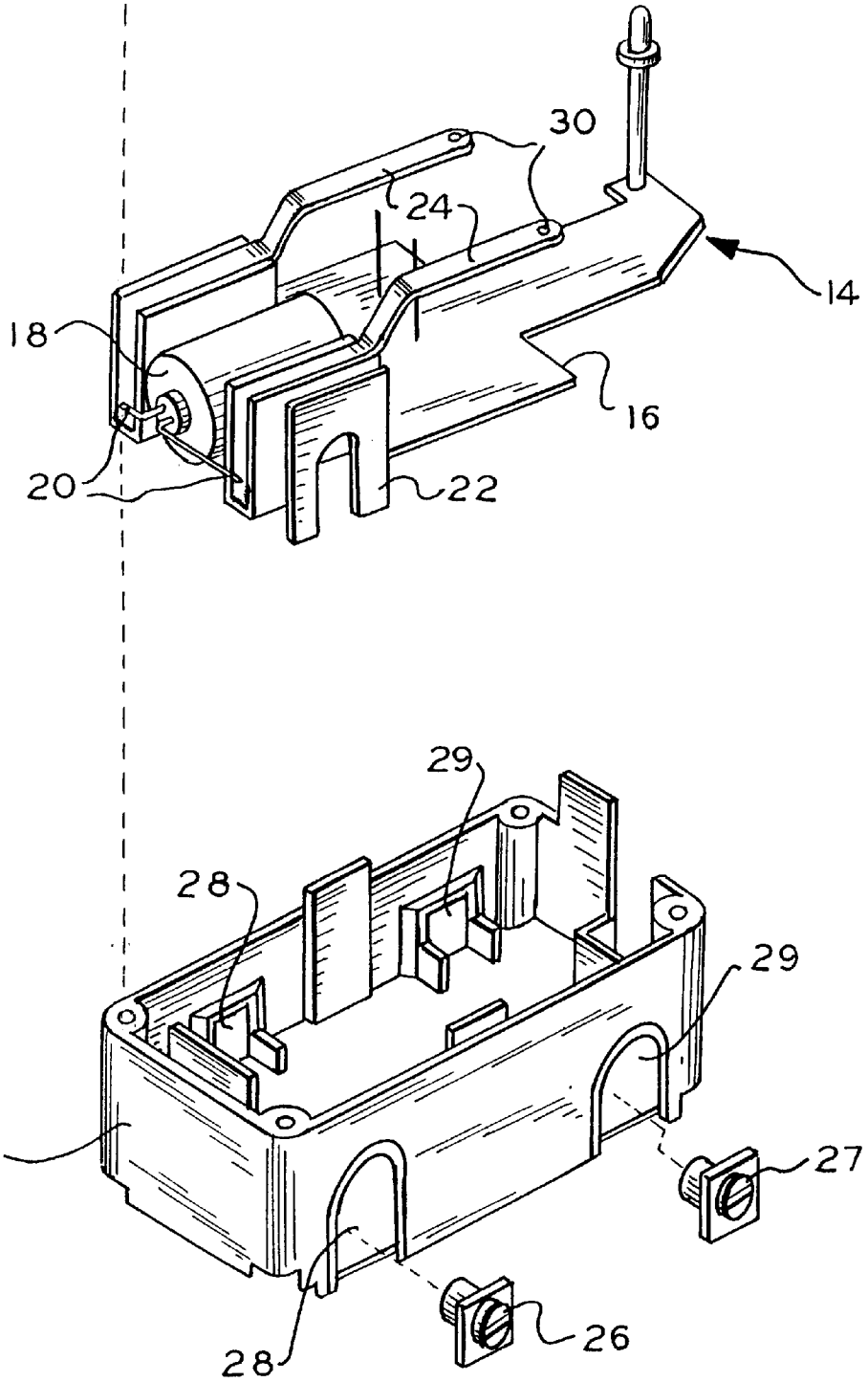
Figure 4:
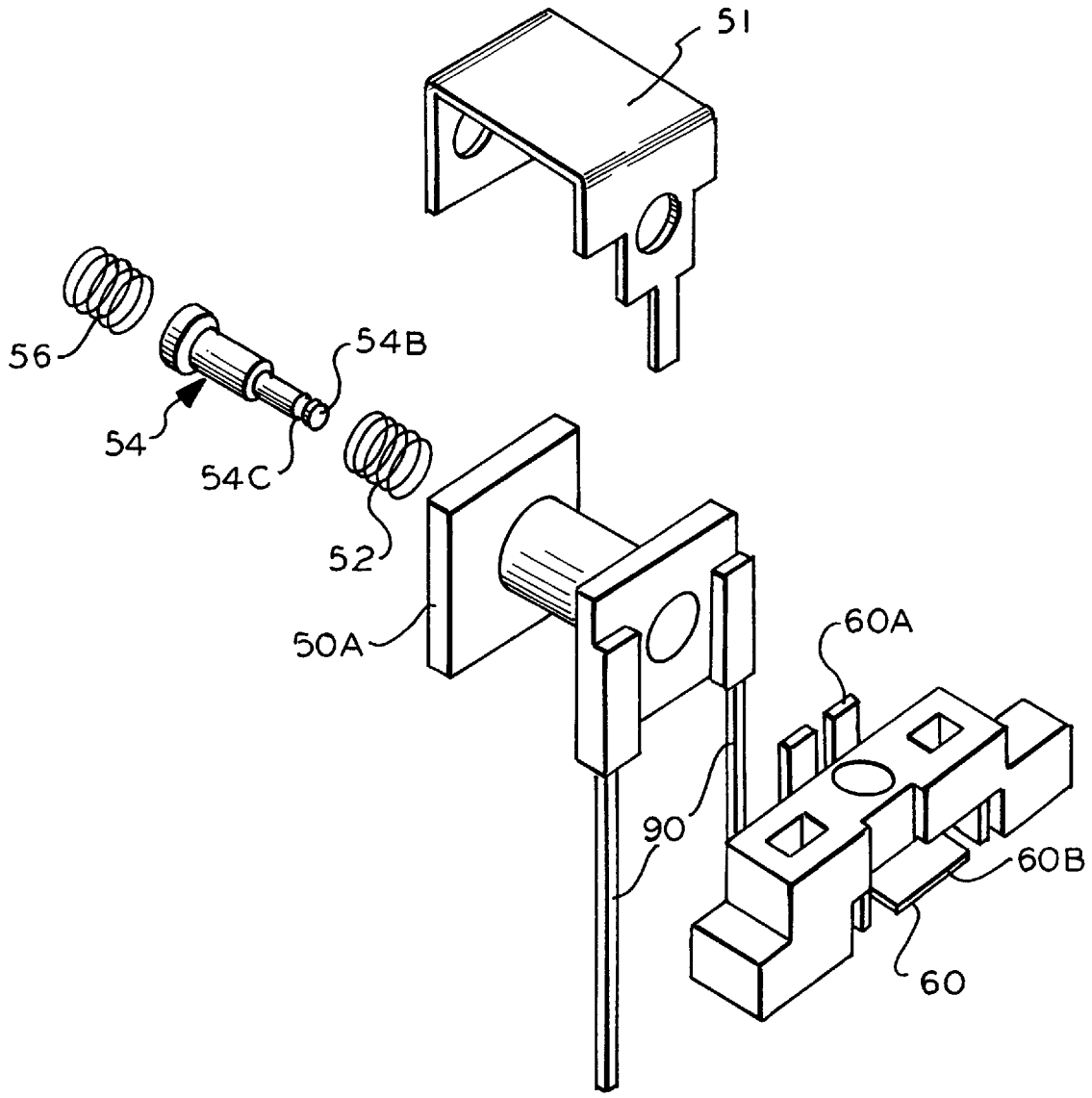
FIG. 4 is an exploded view of the electromagnetic means and a portion of the latch means of FIG. 1.

Once contacts 30 and 70 connect, power is applied to ledges 68 and 72 of contacts 64 and 66 (FIGS. 3A, 3B, and 6). Accordingly, power is then applied to receptacles 64A, 64B, 66A, and 66B. Thus, a plug inserted through the cover 12 through for example slots 44 and opening 46 will connect to the receptacles 64A and 66A to receive power.

Should a ground fault occur, the current flowing through buses 20 will be unequal. This unequal current will produce a net magnetic flux through the toroidal coil 18. The coil 18 produces an output voltage that will be sensed by switching circuitry (not shown) on circuit board 16. In response, the switching circuitry on board 16 will power coil 50 to produce an electromagnetic field. Stainless steel armature 58 will then be attracted to the center of the coil 50.

Armature 58 is shown being so attracted and moving in a direction toward plunger 54 in FIG. 5B. Plunger 54 is not attracted inwardly by the electromagnetic field, since plunger 54 is made of a nonmagnetic material, namely brass. Also, plunger 54 will not become magnetized and be attracted to nearby ferromagnetic components. It is advantageous to get armature 58 moving before attempting to move latch member 60. Latch member 60 experiences a frictional force caused by the pressure of the reset shaft 78 on the underside of the longitudinal arm 60B. If faced immediately with this relatively high frictional force armature 58 would be difficult to move and would demand a relatively high current through the windings 50B of the coil 50. Instead, the armature 58 accelerates over time in the magnetic field caused by coil 50 and will gradually gain kinetic energy before encountering plunger 54.

When the armature eventually strikes plunger 54, there is a transfer of momentum and a relatively high impulse force is applied to plunger 54. This relatively high force is applied through plunger 54 to the latch member 60, which then extends as shown in FIG. 5A. Eventually, the hole 59 in longitudinal arm 60B of latch member 60 will free the reset shaft 78. Consequently, yoke 62 will be driven down under the urging of the cantilevered arms 24 (FIGS. 3A, 3B, and 6). This motion causes moveable contacts 30 to separate from stationary contacts 70 and 74. This separation removes power from the conductive bars 64 and 66 so that the electrical receptacles 64A, 64B, 66A, and 66B are no longer powered. Since screw terminals 27 (FIG. 3) connect to the forked contacts 64C and 66C of bars 64 and 66, these electrical contacts will also be depowered. Accordingly, any load connected to screw terminals 27 will also be protected by the interrupter just described.

As described previously, the reset button 80 can again be depressed to reset the interrupter and the operation will continue as described above.

It will be appreciated that various modifications may be implemented with respect to the above described, preferred embodiment. In some embodiments, the housing may a different number of receptacles than the two illustrated. Also, various types of fault detection circuits can be employed in place of those just described. Although central placement of the solenoid coil is preferred, in other embodiments the coil may be removed to a more remote position, either above or below the separator. While a stainless steel armature and brass plunger are shown inside the solenoid coil, in other embodiments the plunger and armature may be made of different materials. In fact, the plunger need not be metallic, but may be made of plastic, ceramic etc. In some embodiments, a separator may not be employed, and the various illustrated components can be mounted directly onto bosses or sockets molded into the housing. While an L-shaped latch member is shown, in other embodiments the latch member can be curved or may be a simple flat stamping that connects to the plunger in an alternate fashion. While the latch mechanism is shown as a latch member having a hole to grab a groove in a shaft, in other embodiments, a different mechanism may be used instead. Also, the shape and size of various illustrated components can be altered depending upon the desired capacity, strength, thermal stability, etc.

Obviously, many modifications and variations of the present invention are possible in light of the above teachings. It is therefore to be understood that within the scope of the appended claims, the invention may be practiced otherwise than as specifically described.

We claim:

1. A ground fault circuit interrupter for an electrical distribution system, comprising:

a housing;

a pair of stationary contacts and a pair of movable contacts mounted in said housing;

an electromagnetic means mounted in said housing for generating an electromagnetic field;

a plunger slidably mounted at least partially within said electromagnetic means;

an armature slidably mounted at least partially within said electromagnetic means to be magnetically driven thereby against said plunger;

separating means for urging said armature away from said plunger;

a latch means for releasably holding said pair of movable contacts against said pair of stationary contacts, said plunger being operable by said electromagnetic means to engage said latch means and release said pair of movable contacts; and detection means for detecting a fault in the electrical distribution system in order to actuate said electromagnetic means.

2. a ground fault circuit interrupter according to claim 1 wherein said electromagnetic means is operable to drive said armature to extend said plunger away from said electromagnetic means.

3. a ground fault circuit interrupter according to claim 2 wherein said armature comprises a magnetically attractable material and wherein said plunger comprises a non-magnetic material.

4. a ground fault circuit interrupter according to claim 2 further comprising:

retraction means for urging said plunger to retract into said electromagnetic means.

5. a ground fault circuit interrupter according to claim 1 wherein said armature is sized to be normally spaced from said plunger before actuation of said electromagnetic means.

6. a ground fault circuit interrupter according to claim 5 wherein said plunger has an distal tip and a proximal flange, said armature having an proximal stub near the proximal flange of said plunger, said armature having a main body with an outside diameter exceeding that of said proximal stub.

7. a ground fault circuit interrupter according to claim 4 wherein said latch means comprises:

a latch member attached to said plunger to be reciprocated thereby, said retraction means being operable to retract said latch means to a position adjacent to said electromagnetic means.

8. a ground fault circuit interrupter according to claim 4 wherein said electromagnetic means has an axis and wherein said latch means comprises:

a latch member attached to said plunger to be reciprocated thereby, said latch member having a distal end axially spaced from said electromagnetic means.

9. a ground fault circuit interrupter according to claim 1 wherein said housing has a longitudinally centered plane and wherein said electromagnetic means comprises:

a coil located closer to said longitudinally centered plane than said latch means.

10. a ground fault circuit interrupter according to claim 1 comprising:

a separator mounted in said housing, said electromagnetic means and said detection means being located in said housing on opposite sides of said separator.

11. a ground fault circuit interrupter according to claim 10 wherein said housing has a longitudinally centered plane and wherein said electromagnetic means comprises:

a coil located closer to said longitudinally centered plane than said latch means.

12. a ground fault circuit interrupter according to claim 10 wherein said latch means comprises:

a yoke slidably mounted at said separator to reciprocate to and from said separator in order to move said pair of movable contacts; and a latch member positioned between said yoke and said separator and attached to said plunger to be reciprocated thereby.

13. a ground fault circuit interrupter according to claim 12 wherein said yoke is shaped to arch over said latch member.

14. a ground fault circuit interrupter according to claim 12 wherein said latch means comprises:

a shaft for releasable engaging said latch member; and bias means for urging said shaft to move said latch member and said yoke in a direction to move said pair of movable contacts toward said pair of stationary contacts.

15. a ground fault circuit interrupter according to claim 14 wherein said latch member is attached to said plunger with freedom to reciprocate transversely to said plunger.

16. a ground fault circuit interrupter according to claim 14 wherein said latch member has a slot and a hole communicating with said slot, said plunger having a distal tip with a groove for entering said hole and slidably riding in said slot in said latch member, said slot allowing said latch member freedom to reciprocate transversely to said plunger.

17. a ground fault circuit interrupter according to claim 1 wherein said latch means comprises:

a latch member having a slot and a hole communicating with said slot, said plunger having a distal tip with a groove for entering said hole and slidably riding in said slot in said latch member, said slot allowing said latch member freedom to reciprocate transversely to said plunger.

* * * * *